US006854211B1

(12) United States Patent
Blachley

(10) Patent No.: US 6,854,211 B1
(45) Date of Patent: Feb. 15, 2005

(54) REMOVABLE LOUVER AND TILT CONTROL

(76) Inventor: David Blachley, 1967 N. Glassell St., Orange, CA (US) 92865

( * ) Notice: Subject to any disclaimer, the term of this patent is extended or adjusted under 35 U.S.C. 154(b) by 12 days.

(21) Appl. No.: 10/352,766

(22) Filed: Jan. 28, 2003

Related U.S. Application Data

(60) Provisional application No. 60/352,908, filed on Jan. 29, 2002.

(51) Int. Cl.[7] ..... E06B 7/096; E06B 7/086

(52) U.S. Cl. ..... 49/82.1; 49/87.1; 49/74.1

(58) Field of Search ..... 49/82.1, 87.1, 49/80.1, 79.1, 74.1, 73.1, 403; 454/277, 278, 280, 281, 309

(56) References Cited

U.S. PATENT DOCUMENTS

| | | | | |
|---|---|---|---|---|
| 3,491,481 A | | 1/1970 | Wunderlick | |
| 4,380,857 A | | 4/1983 | Senuma et al. | |
| 4,655,003 A | | 4/1987 | Henley, Sr. | |
| 5,194,310 A | | 3/1993 | Lenderink | |
| 5,216,837 A | * | 6/1993 | Cleaver et al. | 49/82.1 |
| 5,379,551 A | * | 1/1995 | Swapp | 49/82.1 |
| 5,392,561 A | | 2/1995 | Henley, Sr. | |
| 5,469,658 A | * | 11/1995 | Digianni et al. | 49/82.1 |
| 5,483,873 A | | 1/1996 | Koivukunnas et al. | |
| 5,490,353 A | | 2/1996 | McLaughlin | |
| 5,630,295 A | | 5/1997 | Neiman | |
| 5,778,598 A | | 7/1998 | Ohanesian | |
| 5,887,386 A | | 3/1999 | Alexanian et al. | |
| 5,996,672 A | | 12/1999 | Kotin | |
| 6,125,906 A | | 10/2000 | Kotin | |
| 6,145,251 A | | 11/2000 | Ricci | |
| 6,314,680 B1 | | 11/2001 | Buckwalter et al. | |
| 6,401,391 B2 | | 6/2002 | Gabriele | |
| 6,467,219 B1 | | 10/2002 | Gardner | |
| 6,536,162 B2 | * | 3/2003 | LaMay | 49/403 |
| 6,701,669 B1 | * | 3/2004 | Yorgason | 49/82.1 |
| 6,732,475 B1 | | 5/2004 | Lee | |

* cited by examiner

*Primary Examiner*—Hugh B. Thompson, II
(74) *Attorney, Agent, or Firm*—Glenn R. Smith

(57) ABSTRACT

A tilt control is adapted to rotate a louver between at least a partially open position and a partially closed position within a shutter frame. The tilt control comprises a stile adapted as a portion of the shutter frame and a gear rotatably retained within the stile. A rack slideably retained within the stile. The gear engages the rack so that linear movement of the rack causes a corresponding rotation of the gear. The louver removably connected to the gear so that rotation of the gear rotates the louver.

7 Claims, 18 Drawing Sheets

REMOVABLE LOUVER AND TILT CONTROL

CROSS-REFERENCE TO RELATED APPLICATIONS

This application relates to and claims the benefit of prior U.S. Provisional Patent Application No. 60/352,908 entitled *Removable Louver and Tilt Control*, filed Jan. 29, 2002, is incorporated by reference herein.

BACKGROUND OF THE INVENTION

Shutters are a high quality interior window treatment, having a combination of style, functionality and elegance that sets them apart from other window coverings. Shutters provide warmth in the winter and protect from damaging heat and sunlight in the summer. Shutters also provide complete control of view, privacy and light.

SUMMARY OF THE INVENTION

FIGS. 1–2 illustrate a shutter 100 having stiles 110, spreaders 120, louvers 140 and a tilt bar 140. As shown in FIG. 1, the shutter 100 is installable within a window opening and operable to control the amount of light entering a building interior and to maintain the privacy of the building occupants, in a manner that is well known in the art. The stiles 110 are attached to the spreaders 120 so as to form a shutter frame having a generally rectangular opening. The louvers 130 are rotatably mounted to the stiles 110 within the frame. The tilt bar 140 is linked to the leading edges of the, louvers 130 and operable up and down so as to rotate the louvers to various positions. The shutter 100 has a closed position (shown) with the tilt bar 140 in a fully up position and the louvers 130 overlapping along the edges so as to block light from passing. The shutter 100 also has various open positions (not shown) with the tilt bar 140 positioned away from the fully up position and the louvers 130 rotated so as to allow light to pass.

As shown in FIG. 2, the louvers 130 are rotatably mounted to the stiles 110 using louver pins 210. One or more selected louvers 130 receive a pair of standard roundhead screws 230 instead of a louver pin 210. The screws 230 function as an adjustable louver tension control. The tilt bar 140 is attached to an edge of each of the louvers 130 with an interlocked tilt bar link 240 and louver link 250.

A disadvantage of a shutter 100 is that louver tilt control utilizes a tilt bar that is located within the shutter frame 110, 120 field-of-view. Another disadvantage of the shutter 100 is that shutter frame disassembly is needed to replace a damaged louver 130. A shutter that overcomes some of the disadvantages of conventional shutters is described in U.S. patent application Ser. No. 09/954,541 entitled *Prefinished Medium Density Fiberboard Shutter*,invented by the inventor of the current application and incorporated by reference herein. One aspect of a removable louver and tilt control is a tilt control adapted to rotate a louver between at least a partially open position and a partially closed position within a shutter frame. The tilt control comprises a stile adapted as a portion of the shutter frame and a gear rotatably retained within the stile. A rack is slideably retained within the stile. The gear engages the rack so that linear movement of the rack causes a corresponding rotation of the gear. The louver is removably connected to the gear so that rotation of the gear rotates the louver.

DETAILED DESCRIPTION OF THE PREFERRED EMBODIMENTS

Figure 1:
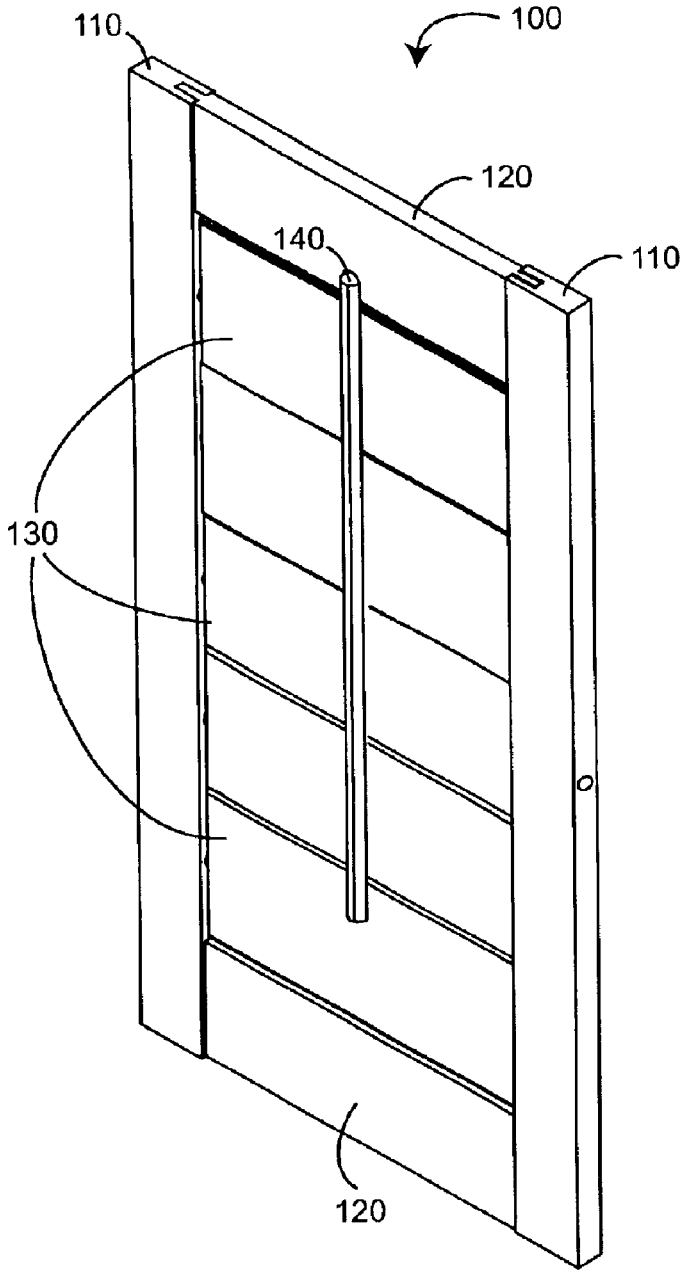
FIG. 1 is a perspective view of a shutter having a tilt bar.
Figure 2:
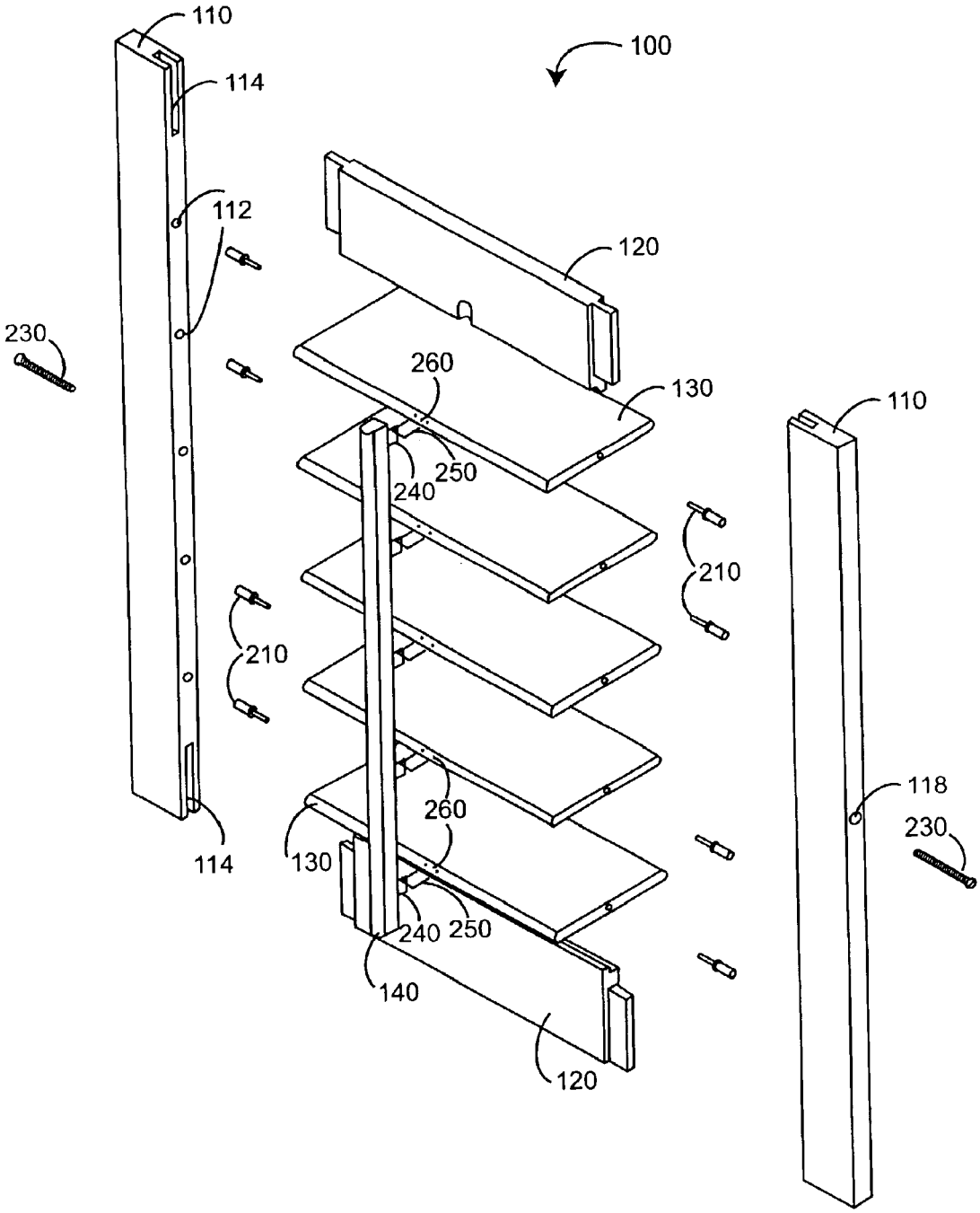
FIG. 2 is an exploded perspective view of a shutter having a tilt bar.
Figure 3:
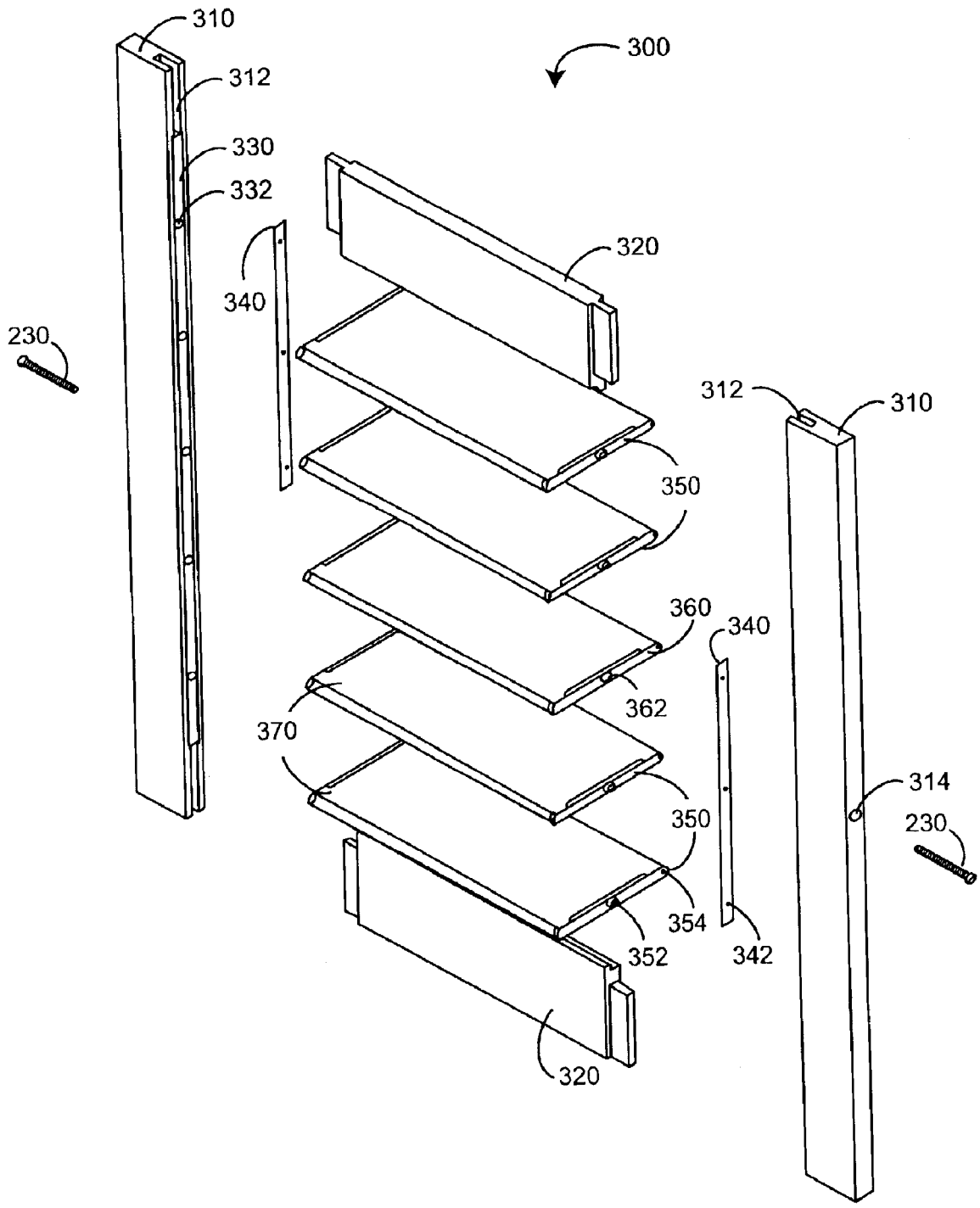
FIG. 3 is an exploded perspective view of a shutter having louver end caps that provide removable louvers and a segmented link bar that provides tilt control.

FIG. 3 illustrates a shutter 300 having full groove stiles 310, spreaders 320, stile inserts 330, segmented link bars 340, and louver end caps 350, 360. The segmented link bars 340 advantageously eliminate the need for a tilt bar 140 (FIGS. 1–2), clearing the field-of-view. The louver end caps 350 advantageously provide for removable louvers 370, which allow the repair or replacement of broken or damaged louvers without disassembly of the shutter frame 310, 320 and ease louver cleaning. The full groove stile 310 has an end to end groove 312, which can be cut in a single manufacturing step across several stiles as compared with end-proximate partial grooves 114 (FIG. 2). The end-to-end groove 312 accommodates a stile insert 330 that includes pin holes 332, which eliminates the manufacturing steps required for drilling pin holes 112 (FIG. 2) along the stile 110 (FIG. 2). A louver end cap 350 is adapted to removably retain a louver 370. A snap-fit stile button 352 is adapted to press fit into and lock inside an insert pin hole 332 so that a louver 370 can be removably installed between stiles 310. A snap-fit link bar button 354 is adapted to press fit into and hold within a link bar hole 342 so that a link bar 340 can connect multiple louvers 370. In one embodiment, the snap-fit buttons 352, 354 extend normally from a face of the end cap 350 and have a catch that snaps and locks inside a pin hole 332 or link bar hole 342, respectively.

The capped louvers 370 advantageously reduce manufacturing steps and parts by eliminating pin holes 112 (FIG. 2), louver pins 210 (FIG. 2), link holes 260 (FIG. 2) and associated links 240, 250 (FIG. 2). Screw holes can be pre-drilled in one or more selected louvers 370 so as to provide louver tension control, as described above. In that case, louver caps 360 are installed with screw holes 362 in place of snap-fit buttons 352. The louvers 370 are opened and closed by moving an individual louver, which moves all louvers 370 via the link bars 340. A shutter embodiment having full groove stiles, stile inserts, louver end caps, removable louvers and extended link bars is described in detail in U.S. patent application Ser. No. 09/954,541, cited above.

As shown in FIG. 3, the segmented link bar 340 is advantageously configured to attach on alternating opposite ends of overlapping louver groups so that all louvers 370 are effectively linked together. For example, each link bar may have a length sufficient to attach to a group of three louvers. Five louvers may then be linked together as two overlapping groups of three louvers, using one link bar segment each to attach to opposite louver ends, as shown. Multiple segmented link bars 340 advantageously have better rigidity than a single, extended link bar of the same length. Further, link bar segments having a standardized length can accommodate shutters having various numbers of louvers. Described below are rack and gear stile assemblies providing alternative removable louver and tilt control embodiments to the extended link bar or segmented link bar embodiments described above.

Figure 4:
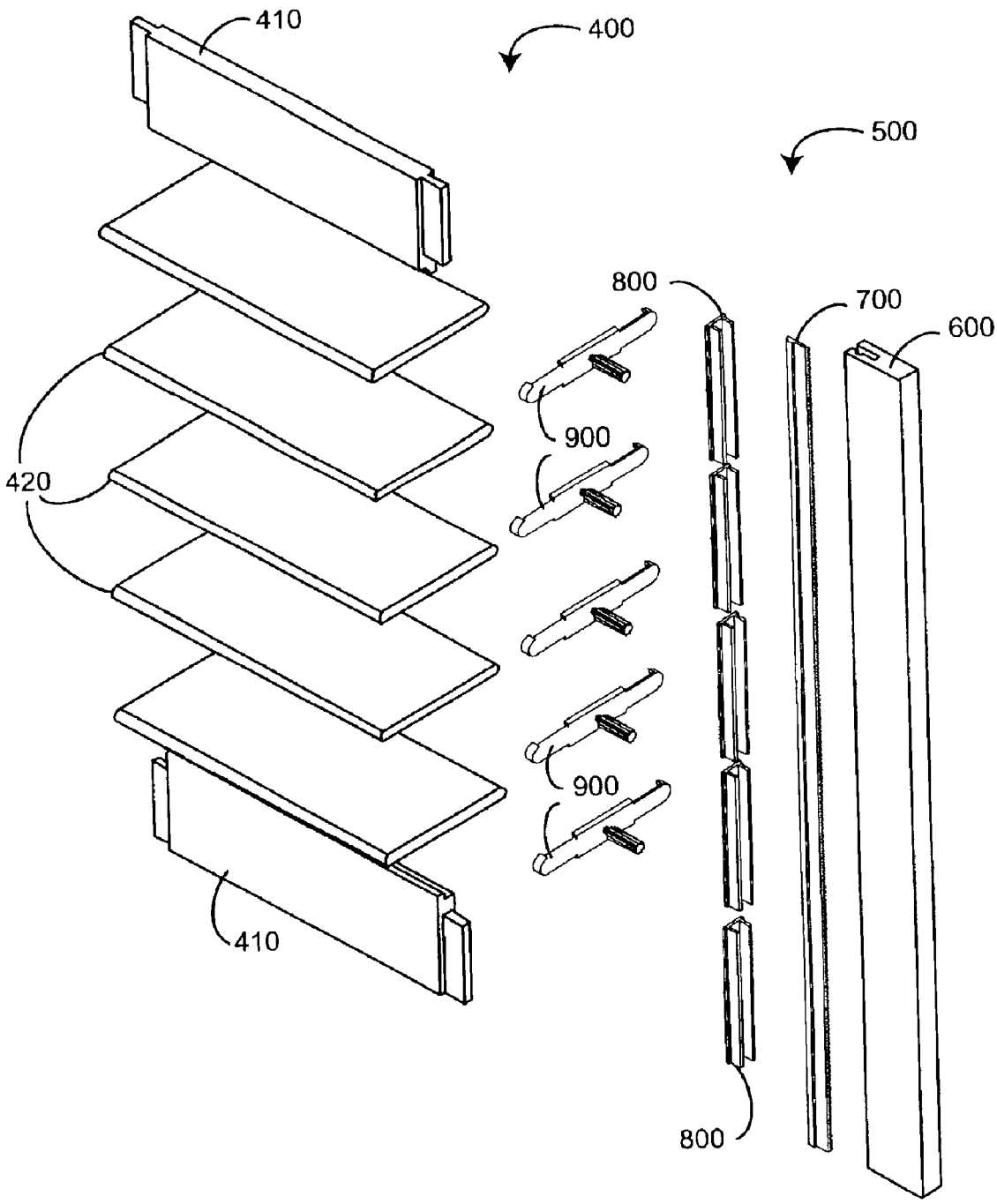
FIG. 4 is an exploded perspective view of a shutter portion having removable louvers and a rack and gear stile assembly.

FIG. 4 illustrates a shutter portion 400 having spreaders 410, louvers 420 and a stile assembly 500. The spreaders 410 are fixedly attached to the stile assembly 500 to form a shutter frame. The stile assembly 500 accommodates end caps 900 that provide for removable louvers 420, such as described above. The stile assembly 500 also incorporates a rack and gear tilt control for the louvers 420 that does not block the field-of-view. In one embodiment, the end caps 900 extend through stile inserts 800 and engage a toothed strip 700 installed within the stile 600: This embodiment is described in detail with respect to FIGS. 5–10, below. Alternative rack and gear stile assembly embodiments are described with respect to FIGS. 11–14, below.

Figure 5A:
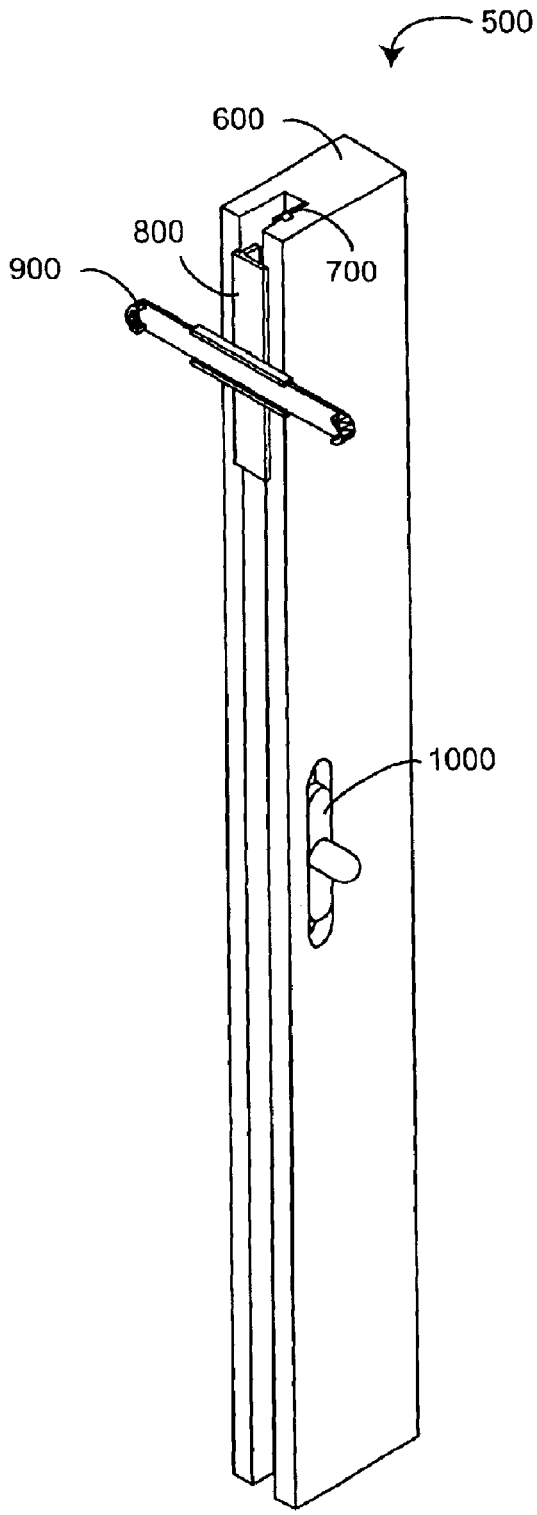
FIGS. 5A–B are assembled and exploded perspective views, respectively, of a rack and gear stile assembly having geared louver end caps, segmented stile inserts, a toothed groove strip and a tilt control lever.
Figure 5B:
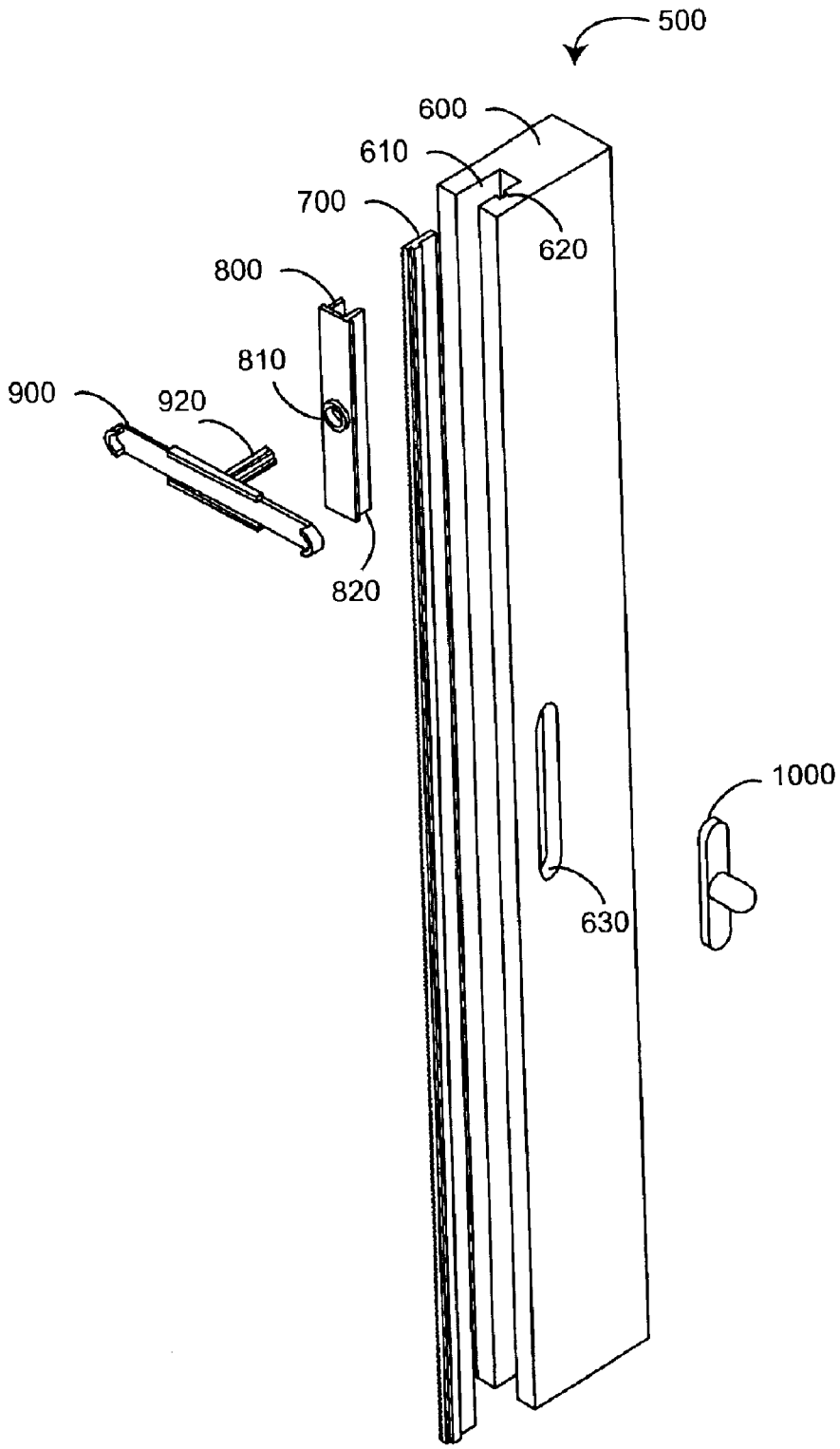
Figure 6A:
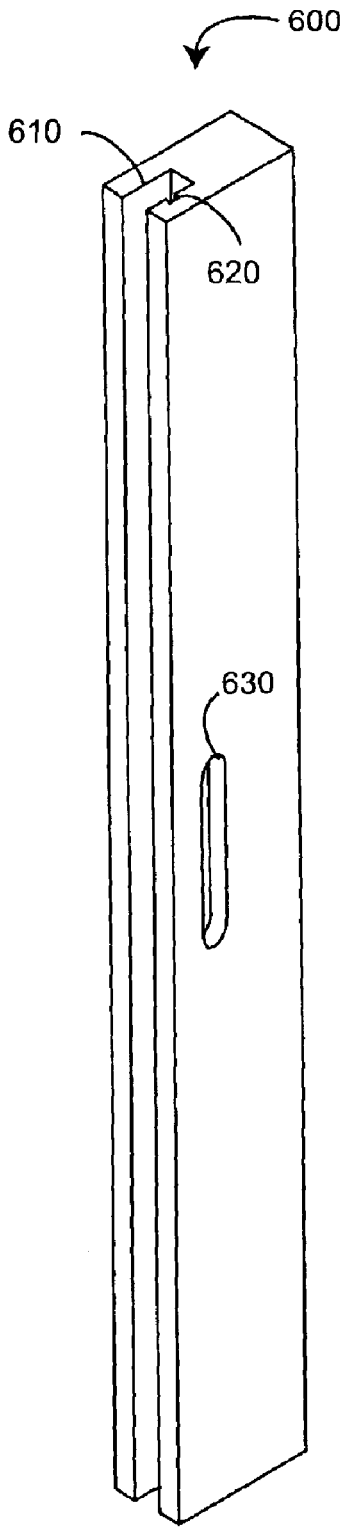
FIGS. 6A–B are inside and outside perspective views, respectively, of a full groove stile having a secondary groove.
Figure 6B:
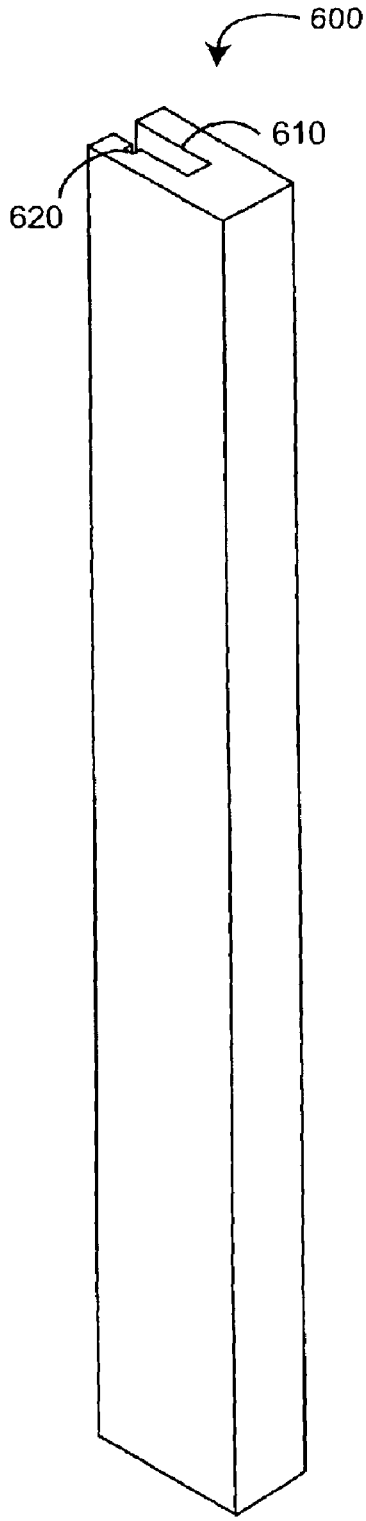
Figure 7A:
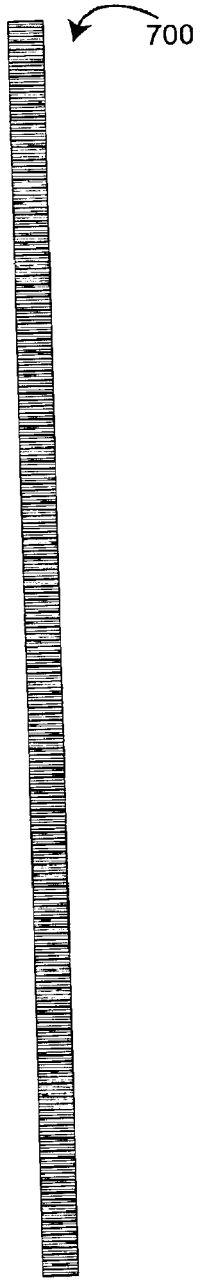
FIGS. 7A–E are front, side, perspective, bottom end and detailed perspective views, respectively, of a toothed strip.
Figure 7B:
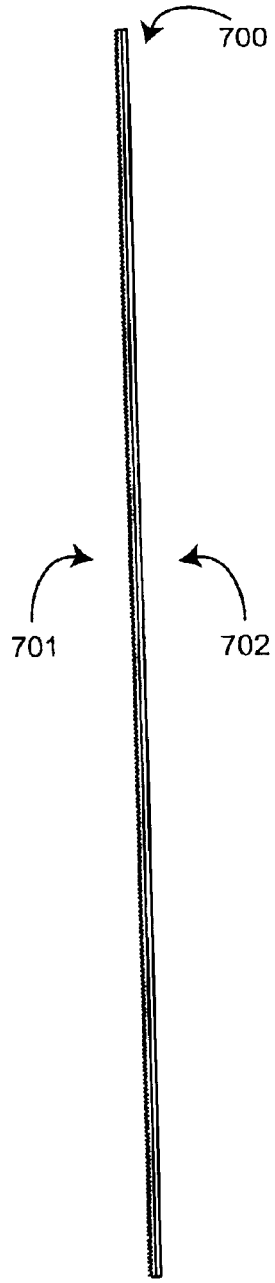
Figure 7C:
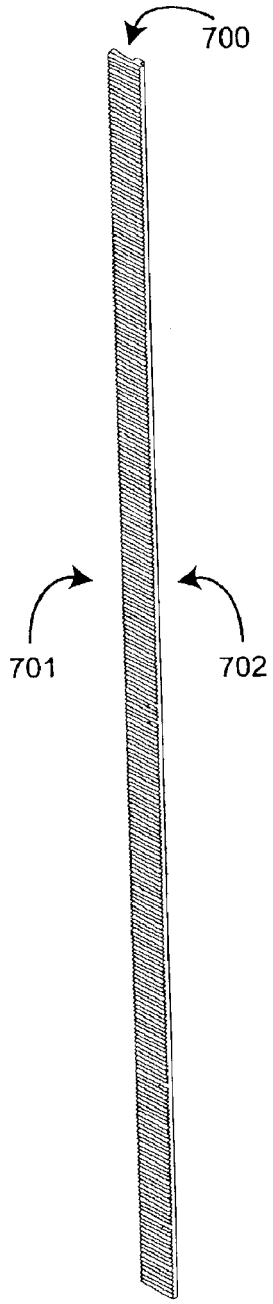
Figure 7D:
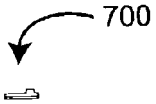
Figure 7E:
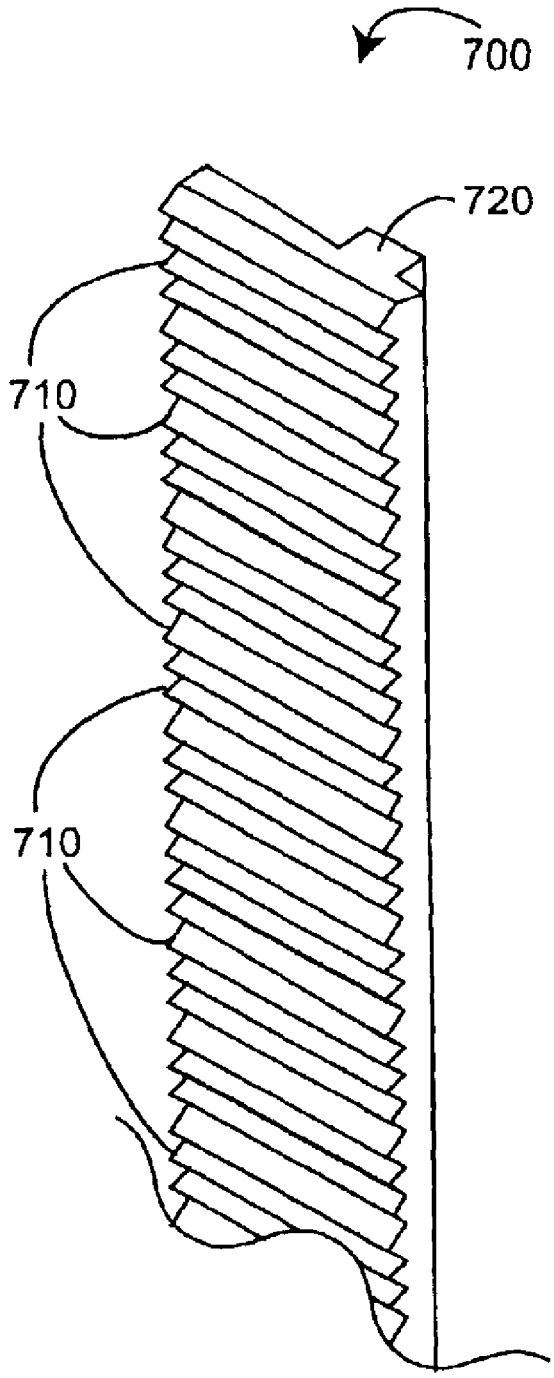
Figure 8A:
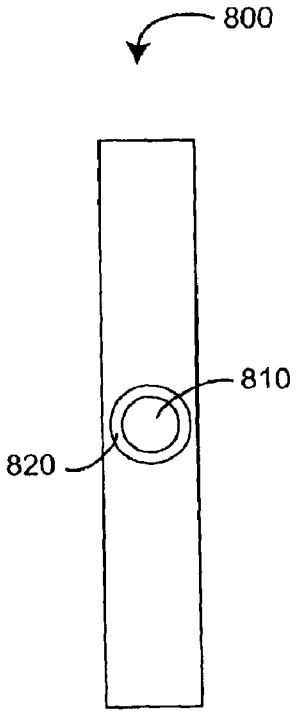
FIGS. 8A–D are front, side, perspective and bottom end views, respectively, of a segmented insert.
Figure 8B:
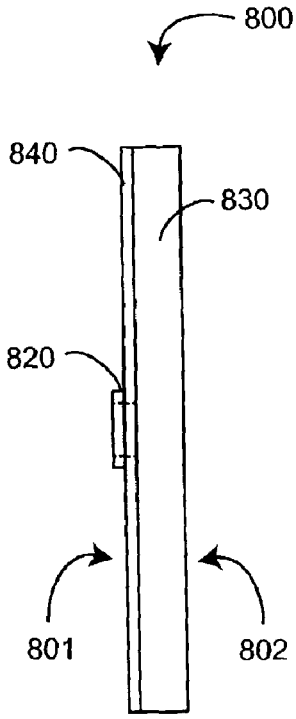
Figure 8C:
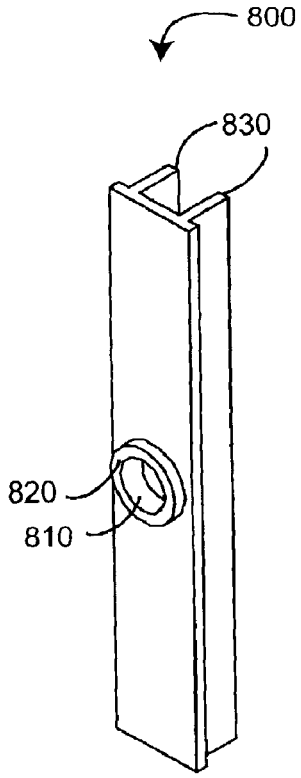
Figure 8D:
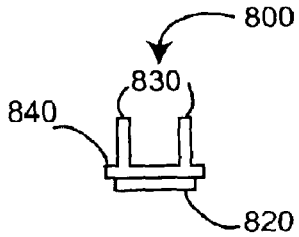
Figure 10A:
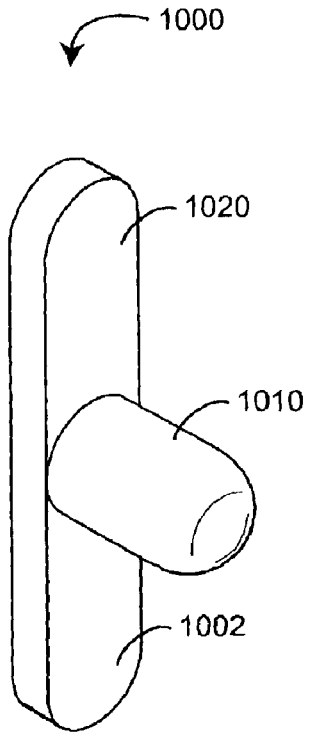
FIGS. 10A–C are front perspective, back perspective and side views, respectively, of a tilt control louver.
Figure 10B:
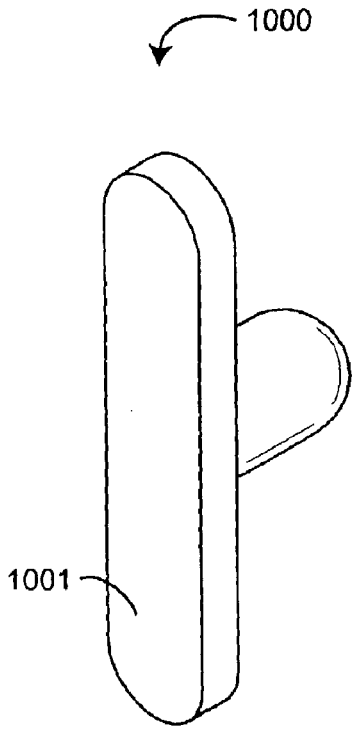
Figure 10C:
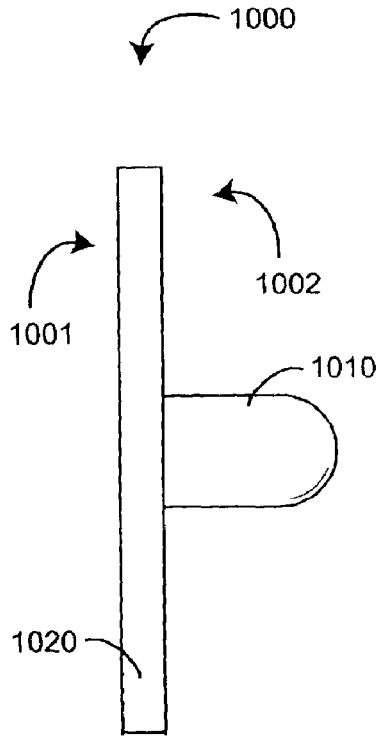

FIGS. 5A–B illustrate a stile assembly 500 having a full groove stile 600, a toothed groove strip 700, segmented stile inserts 800, and geared end caps 900. Alternatively, the stile assembly 500 has a single stile insert that extends a substantial portion of the stile groove 610 (FIGS. 6A–B) in lieu of segmented stile inserts 800. A complete stile assembly 500 has multiple segmented stile inserts 800 and end caps 900. The stile assembly 500 may also have a tilt control lever 1000 or a control knob 1150 (FIGS. 11A–B), as described below. Before or after frame assembly, the groove strip 700, stile inserts 800 and geared end caps 900 are installed in the stile 600. Advantageously, the end caps 900 are constructed of a material having some flexibility, such as a thin plastic, so that the end caps 900 can be deflected for louver removal and replacement. An end cap 900 has a gear 920 extending generally perpendicular to the end cap 900. The gear 920 is press-fit through a corresponding insert aperture 810 and into a stile groove 610. The gear 920 engages the toothed strip 700 so that linear movement of the strip 700 within the stile groove 610 rotates all of the end caps 900 and associated louvers 420 (FIG. 4). The strip 700 is slidably retained within a secondary stile groove 620. An optional control lever 1000 inserts through a stile cutout 630 and attaches to the strip 700, such as with glue, so that linear movement of the control lever 1000 causes linear movement of the groove strip 700 and a corresponding rotation of the end caps 900 and associated shutter louvers 420 (FIG. 4). FIGS. 6A–B illustrate a stile 600 having a full length groove 610, a secondary groove 620 and a stile cutout 630. FIGS. 10A–C illustrate a control lever 1000 having a back face 1001 that contacts the groove strip 700, a front face 1002, and a handle 1010 extending generally perpendicular to the front face 1002.

FIGS. 7A–E illustrate an elongated, generally planar toothed strip 700 having a toothed face 701 and an opposite smooth face 702. A tongue 720 extends generally perpendicularly from the smooth face 702 and is configured to removably retain the strip 700 within the stile secondary groove 620 (FIGS. 6A–B), as described with respect to FIGS. 5A–B, above. In one embodiment, the toothed strip 700 extends a substantial portion of the stile groove 610 (FIGS. 6A–B). In an alternative embodiment, the toothed strip 700 is segmented with interlocking ends, where each segment extends a fractional portion of the stile groove 610 (FIGS. 6A–B).

Figures 9A, 9B:
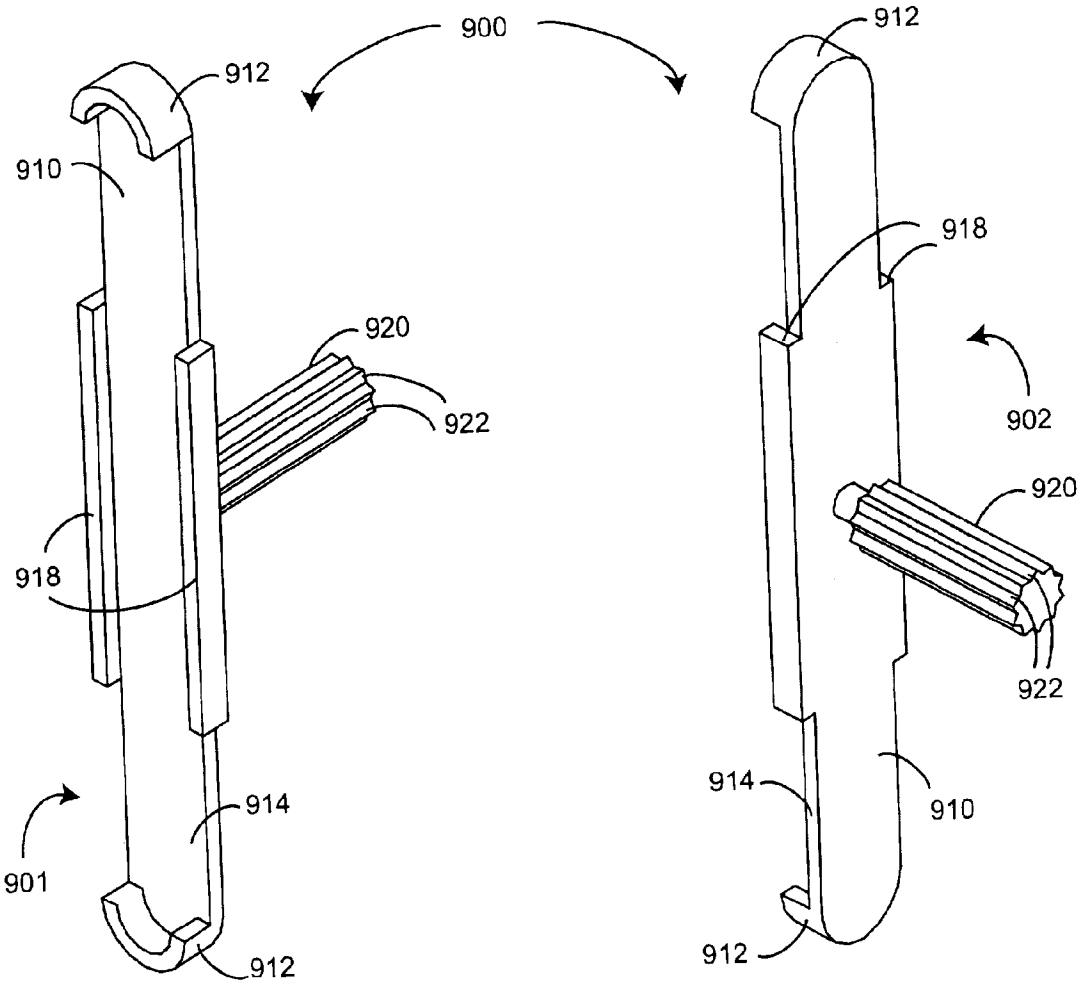
FIGS. 9A–B are inside and outside perspective views, respectively, of a geared louver end cap that provides for a removable louver.

FIGS. 8A–D illustrate a segmented insert 800 having an outside face 801 and an inside face 802. An aperture 810 is generally centered on the outside face 801 and extends to the inside face 802. A collar 820 is disposed around the aperture 810 perimeter. and extends from the outside face 801. Legs 830 extend generally perpendicular from the back face 802. The aperture 810 accommodates an end cap gear 920 (FIGS. 9A–B), which is inserted through the aperture 810 from the outside face 801. The collar 820 provides spacing between the front face 801 and an end cap 900 (FIGS. 9A–B). The legs 830 are spaced to fit within the stile groove 610 (FIGS. 6A–B) so that a shelf 840 rests on the stile 600 (FIGS. 6A–B) along the periphery of the groove 610 (FIGS. 6A–B).

FIGS. 9A–B illustrate a geared end cap 900 having a cap body 910, side flaps 918, end flaps 912 and a gear 920. The cap body 910 is generally planar with an inside face 901 and an outside face 902. The cap body 910 is adapted to cover the end of a louver 420 (FIG. 4) so that the inside face 901 is proximate the louver 420 (FIG. 4) and the outside face 902 is distal the louver 420 (FIG. 4). The side flaps 920 and end flaps 940 extend normal to the body 910 from the inside face 901 and are configured so that the side flaps 920 grip the faces of a louver 420 (FIG. 4) and the end flaps 940 grip the edges of a louver 420 (FIG. 4). Accordingly, an end cap 900 is constructed of a material having some flexibility, such as a thin plastic, so that one or more of the side flaps 920 and end flaps 940 can be deflected for attachment to, or detachment from, a louver 420 (FIG. 4). In an alternative embodiment, not shown, the side flaps 920 or end flaps 940 or both are replaced by a wedge, prongs or similar structure extending from the center of the inside face 901 and adapted to insert into, and fixedly attached to, an end of a louver 420 (FIG. 4). The gear 920 is adapted to insert through a groove insert aperture 810 (FIGS. 8A–B) so that the gear teeth 922 engage the teeth of a groove strip 700 (FIGS. 7A–E), a segmented slider 1200 (FIGS. 12A–E) or a stackable slider 1400 (FIGS. 14A–D) within a stile groove 610 (FIGS. 6A–B).

Figure 11A:
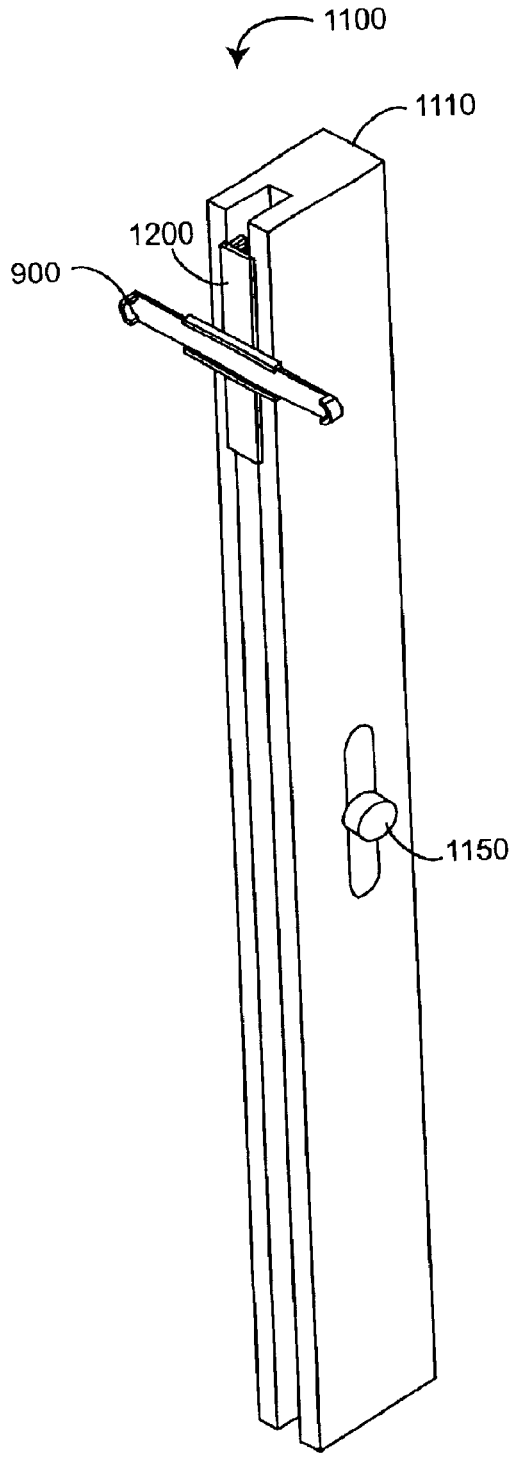
FIGS. 11A–B are assembled and exploded perspective views, respectively, of a rack and gear stile assembly having geared louver end caps, segmented stile inserts, segmented sliders and a tilt control knob.
Figure 11B:
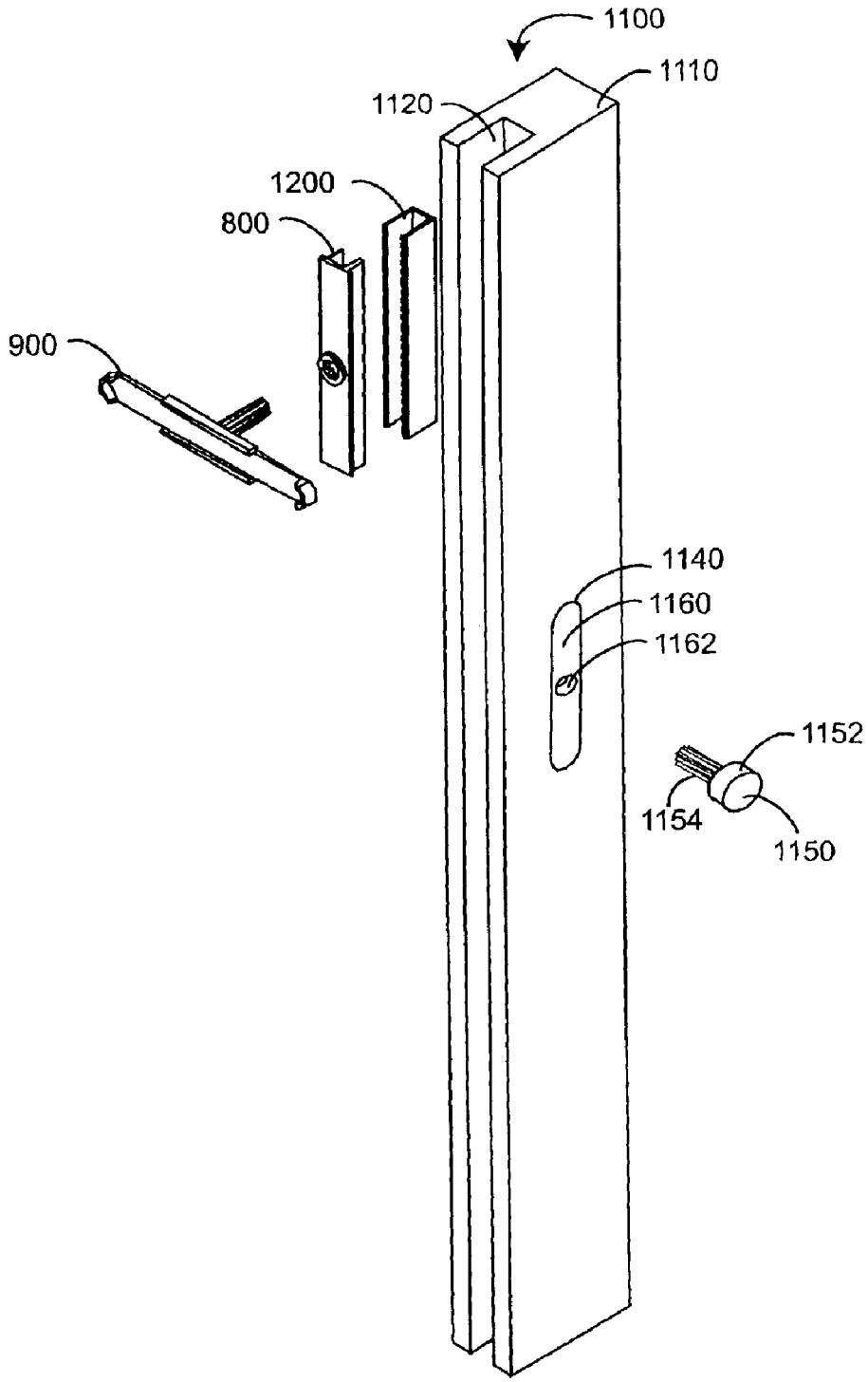
Figures 12A, 12B, 12C, 12D:
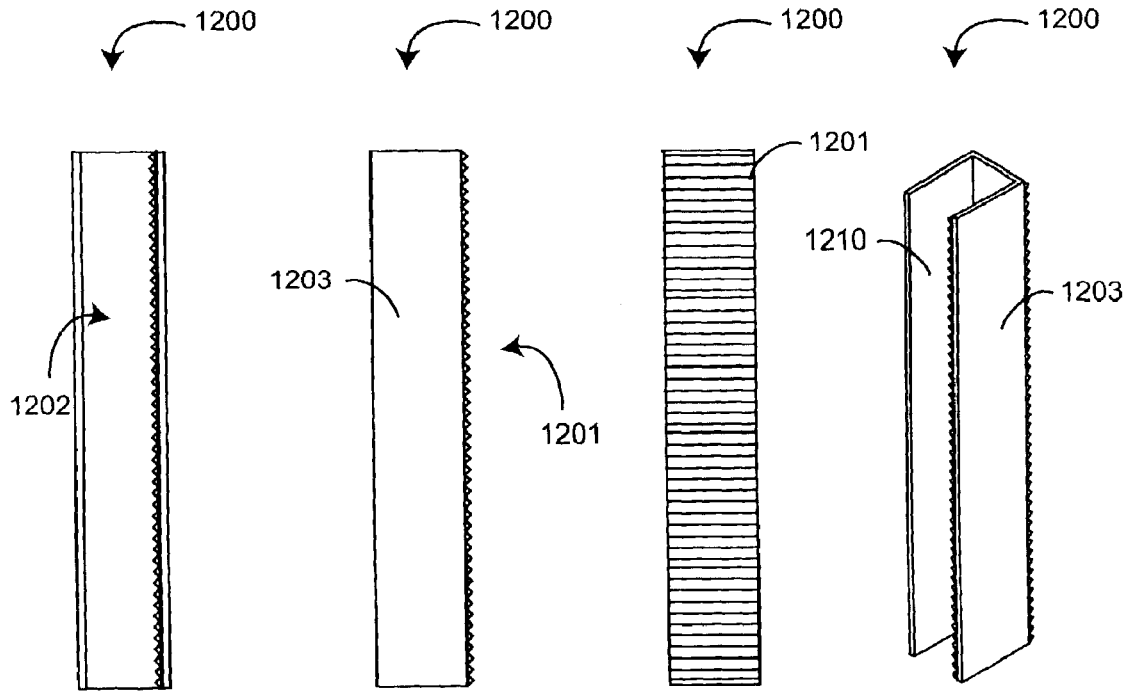
FIGS. 12A–E are front, side, back, perspective and bottom end views, respectively, of a segmented slider.
Figure 12E:
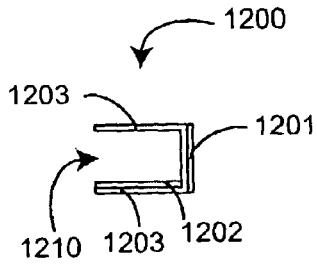

FIGS. 11A–B illustrate a stile assembly 1100 utilizing a toothed segmented slider 1200 and a tilt control knob 1150. A complete stile assembly 1100 has multiple segmented inserts 800, segmented sliders 1200 and end caps 900. Alternatively, the stile assembly 1100 has a single stile insert and/or a single slider that extend a substantial portion of the stile groove 610 (FIGS. 6A–B) in lieu of segmented inserts 800 and/or segmented sliders 1200, respectively. The end cap 900 gears engage teeth of the segmented sliders 1200 so that linear movement of the segmented sliders 1200 rotates the end caps 900 and tilts attached louvers accordingly, as described in detail with respect to FIGS. 12A–E, below. The tilt control knob 1150 has a toothed gear 1154 extending generally perpendicular to a knob handle 1152 that engages teeth of a driven segmented slider. The driven slider pushes against an adjacent slider causing linear movement of all sliders 1200 in a chosen direction so as to tilt the shutter louvers 420 (FIG. 4). The tilt control knob gear 1154 is press-fit through an aperture 1162 of a cutout bracket 1160, retaining the control knob 1150. The cutout bracket 1160 is fixedly installed within a stile cutout 1140 on a face of the stile 1110. In an alternative embodiment, a tilt control lever 1000 (FIGS. 10A–C) is installed in the stile cutout 1140 and is fixedly attached to one side of a slider 1200. In this manner, linear movement of the control lever L100 (FIGS. 10A–C) tilts the shutter louvers 420 (FIG. 4) in a manner similar to that described with respect to FIGS. 5A–B, above.

FIGS. 12A–E illustrate a toothed segmented slider 1200 having a generally U-shaped cross-section, an outside toothed face 1201 along the back that is adapted to engage a control knob gear 1154 (FIGS. 11A–B), an inside toothed face 1202 along one side that is adapted to engage an end cap gear 920 (FIGS. 9A–B), and smooth outside faces 1203 slidably retained by a stile groove 610 (FIGS. 6A–B). The end cap gears 920 (FIGS. 9A–B) engage the teeth of the inside face 1202 so that linear movement of the segmented sliders 1200 rotate corresponding end caps 900 (FIGS. 11 A–B) and tilt an attached louver accordingly. The tilt control knob 1150 (FIG. 11B) has a toothed gear 1154 (FIG. 11B) extending generally perpendicular to a knob handle 1152 (FIG. 11B) that engages the teeth of a slider outside face 1201 so that rotation of the knob 1150 drives the linear movement of a slider 1200.

Figure 13A:
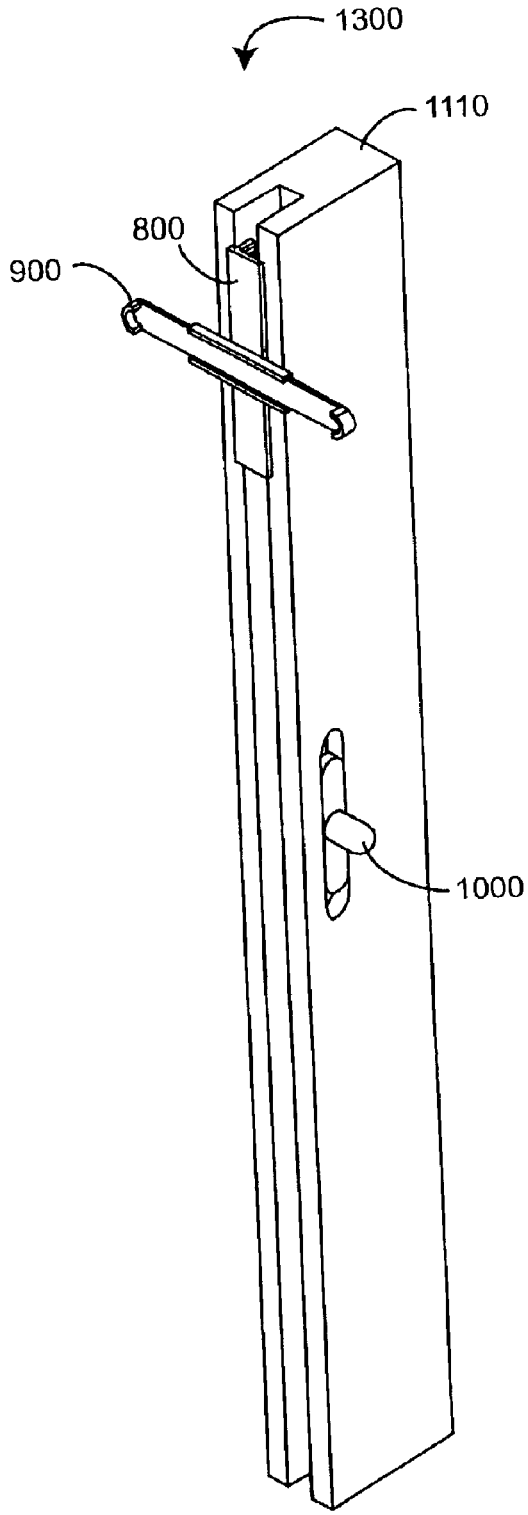
FIGS. 13A–B are assembled and exploded perspective views, respectively, of a rack and gear stile assembly having geared louver end caps, segmented stile inserts, stackable sliders and a tilt control lever.
Figure 13B:
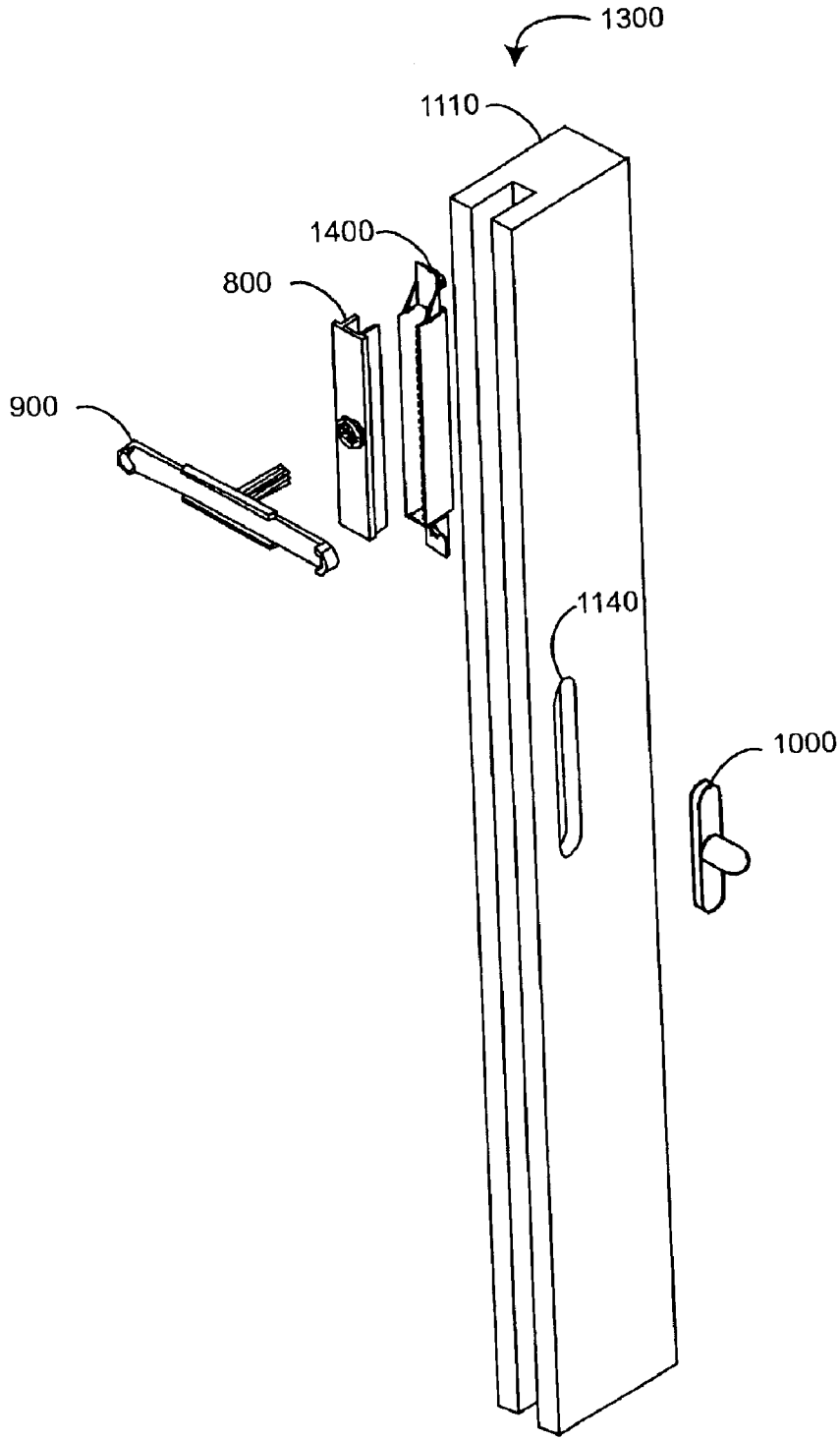
Figure 14A:
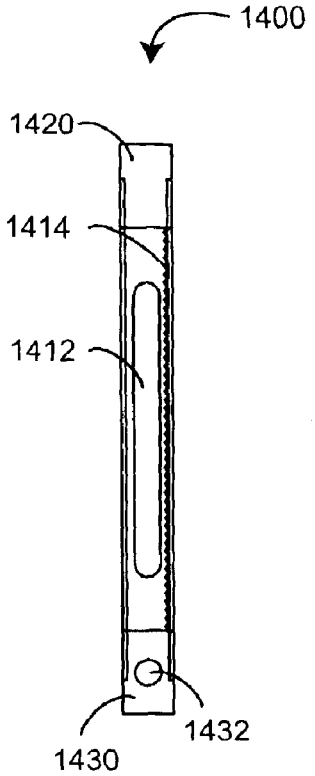
FIGS. 14A–D are front, side, perspective and bottom end views, respectively, of a stackable slider.
Figure 14B:
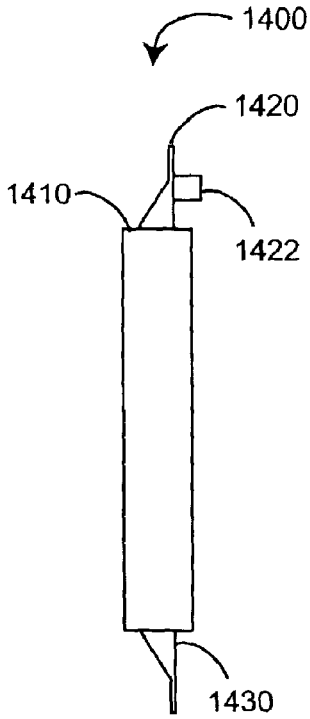
Figure 14C:
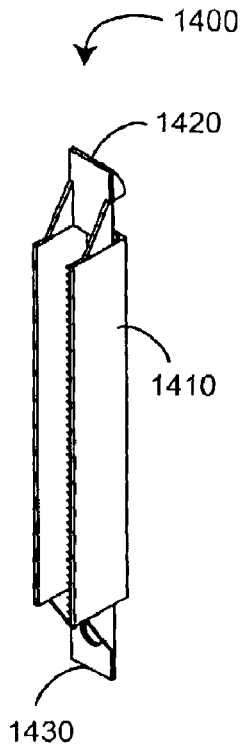
Figure 14D:
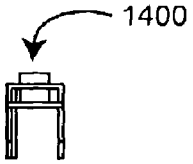

FIGS. 13A–B illustrate a stile assembly 1300 utilizing a stackable slider 1400. A complete stile assembly 1300 has multiple inserts 800, stackable sliders 1400 and end caps 900. Alternatively, the stile assembly 1300 has a single stile insert that extends a substantial portion of the stile groove 610 (FIGS. 6A–B) in lieu of segmented inserts 800. Stackable sliders 1400 engage end caps 900 so that linear movement of the stackable sliders 1400 rotate the end caps 900 and tilt associated louvers 430 (FIG. 4), as described with respect to FIGS. 14A–D, below. In one embodiment, shown, a control lever 1000 installed through a stile cutout 1140 linearly actuates the stackable sliders 1400, providing tilt control. In another embodiment, a stackable slider 1400 engages a control knob gear for tilt control, in a manner similarly described with respect to FIGS. 11A–B, above. In yet another embodiment, an electric motor is mounted, for example, proximate a bottom spreader 410 (FIG. 4) and has a lever attached to any of the tilt control mechanisms described above so as to provide powered and/or remote control louver tilting.

FIGS. 14A–D illustrate a stackable slider 1400 having a body 1410 with a generally U-shaped cross section, a first tab end 1420 and an opposite second tab end 1430. The body 1410 has a slotted back face 1412, a toothed inside face 1414 and smooth outside faces. The stackable slider 1400 inside face 1414 is adapted to engage an end cap gear 920 (FIGS. 9A–B) so as to rotate the end cap 900 (FIGS. 9A–B) with linear slider movement in a manner similar to that of the segmented slider 1200 (FIGS. 12A–E), described above. The stackable slider 1400, however, has an aperture 1432 through one tab end 1430 and a corresponding plug 1422 extending from an opposite tab end 1420 so as to attach to adjacent sliders 1400 for uniform linear movement. The slotted back face 1412 is configured to accept a button (not shown) on an end cap gear 920 (FIGS. 9A–B), allowing it to stabilize the linear movement of the slider 1400. In an alternative embodiment, a stackable slider 1400 has a toothed back face adapted to engage a control knob gear, similar to that described for the segmented slider 1200 (FIGS. 12A–E), above.

Louver end-caps, with or without gears for rack and gear tilt control, advantageously allow a shutter frame to be pre-assembled without the louvers. That is, louvers may be installed in the louver end caps as a manufacturing step occurring after frame assembly. In one embodiment, a shutter frame is pre-assembled from stiles and spreaders as described above. In another embodiment, a shutter frame is carved from a single piece of material using, for example, a CNC mill. In this manner, the manufacture of a variety of frame shapes, such as a sunburst, can be entirely automated.

A removable louver and tilt control shutter has been disclosed in detail in connections with various embodiments. These embodiments are disclosed by way of examples only and are not to limit the scope of the claims that follow. One of ordinary skill in the art will appreciate many variations and modifications.

What is claimed is:

1. A tilt control adapted to rotate a louver between at least a partially open position and a partially closed position within a shutter frame, said tilt control comprising;

a stile adapted as a portion of said shutter frame;

a gear rotatably retained within said stile;

a rack slideably retained within a groove defined by said style,said gear engaging said rack so that linear movement of said rack causes a corresponding rotation of said gear, said louver removably connected to said gear so that rotation of said gear rotates said louver, wherein said rack comprises a segmented slider comprising:

a U-shaped body having an inside and an outside; and a first toothed face on said inside of said body, said first toothed face configured to engage said gear.

2. The tilt control according to claim 1 further comprising:

a control lever adapted to attach to said segmented slider; and a cutout defined between said groove and a face portion of said stile, said cutout configured to accommodate said control lever.

3. The tilt control according to claim 1 wherein said segmented slider further comprises a second toothed face on said outside, said tilt control further comprising:

a control knob;

a control gear extending from said control knob;

a cutout defined between said groove and a face portion of said stile, said cutout configured to accommodate said control gear within a cutout bracket, wherein said control gear is configured to engage said second toothed face so as to linearly move said segmented slider within aid groove as said control knob is rotated.

4. A tilt control adapted to rotate a louver between at least a partially open position and a partially closed position within a shutter frame, said tilt control comprising:

a stile adapted as a portion of said shutter frame;

a gear rotatably retained within said stile;

a rack slidably retained within the stile, said gear engaging said rack so that linear movement of said rack causes a corresponding rotation of said gear, said louver removably connected to said gear so that rotation of said gear rotates said louver, wherein said rack comprises a stackable slider comprising:

a first tab end having a plug;

a second tab end having an aperture corresponding to said plug; and a toothed face configured to engage said gear.

5. A tilt control adapted to rotate a louver between a partially open position and a partially closed position within a shutter frame, said tilt control comprising:

a stile adapted as a portion of said shutter frame a gear rotatably retained within said stile;

a rack slideably retained within said stile, said gear engaging said rack so that linear movement of said rack causes a corresponding rotation of said gear, said louver removably connected to said gear so that rotation of said gear, rotates said louver;

a groove defined by said stile, said groove said to accommodate said rack;

an insert removably retained by said groove, wherein said insert comprises:

a segment body having an outside face and an inside face;

an aperture defined through said body and generally centered on said outside face;

a collar disposed around said aperture on said outside face; and a pair of legs extending generally perpendicularly from said inside face, said legs configured to engage said groove so as to retain said insert at least partially within said groove.

6. A tilt control method comprising the steps of:

defining a groove along a stile portion of a shutter frame;

removably connecting a louver to a gear so that rotation of said gear rotates said louver;

extending said gear into said groove;

placing a first slider into said groove so that inside toothed face of said slider is adapted to engage said gear;

placing a second slider into said groove adjacent said first slider; and stacking said first slider with said second slider.

7. A tilt control method comprising the steps of:

defining a groove along a stile portion of a shutter frame;

removably connecting a louver to a gear so that rotation of said gear rotates said louver;

extending said gear into said groove;

defining a secondary groove along said groove;

placing a toothed strip at least partially within said secondary groove; and engaging said toothed strip with said gear.

* * * * *